United States Patent [19]

Winiasz

[11] 4,293,010

[45] Oct. 6, 1981

[54] ADJUSTABLE VOLUMETRIC FILLER HEAD

[75] Inventor: Michael E. Winiasz, Lorain, Ohio

[73] Assignee: A-T-O Inc., Willoughby, Ohio

[21] Appl. No.: 88,134

[22] Filed: Oct. 25, 1979

[51] Int. Cl.[3] ..... B65B 3/32

[52] U.S. Cl. ..... 141/392; 137/625.27; 222/309; 222/504

[58] Field of Search ..... 137/625.27; 141/1, 128, 141/177, 192, 285, 302, 392; 222/43, 46, 49, 309, 504

[56] References Cited

U.S. PATENT DOCUMENTS

| | | | |
|---|---|---|---|
| 2,761,605 | 9/1956 | Pahl et al. | 141/141 |
| 2,786,601 | 3/1957 | Day et al. | 222/50 |
| 2,974,691 | 3/1961 | Bingham | 141/142 |
| 3,037,536 | 6/1962 | Fechheimer et al. | 141/7 |
| 3,285,300 | 11/1966 | Mistarz | 141/392 |
| 3,509,954 | 5/1970 | Sramcik | 177/122 |
| 3,559,702 | 2/1971 | Riesenberg | 141/128 |
| 3,595,281 | 7/1971 | Laub | 141/46 |
| 3,804,135 | 4/1974 | Waxlax | 141/266 |
| 3,926,229 | 12/1975 | Scholle | 141/1 |
| 4,091,969 | 5/1978 | Easter et al. | 222/309 |

*Primary Examiner*—Frederick R. Schmidt
*Attorney, Agent, or Firm*—Christel, Bean & Linihan

[57] ABSTRACT

A filler head for delivering a preselected volume of product to a container, the head having a charging cylinder and a piston movable in the cylinder to define a product chamber therein. Product is delivered under pressure through a passage to the chamber, the piston being movable under product pressure in a direction enlarging the chamber. Adjustable stop means limit chamber enlarging movement of the piston to determine the preselected volume. A plug entering the passage as the piston approaches the end of its discharge stroke restricts the discharge of product to reduce turbulence. A piston valve is movable between the product passage and an outlet passage, in one position interrupting the delivery of product to the chamber for discharge of product from the chamber through the valve to the outlet, and in another position closing the outlet and permitting delivery of product under pressure to the chamber. The piston valve is removable as a unit from the head, for ease of cleaning.

15 Claims, 2 Drawing Figures

ADJUSTABLE VOLUMETRIC FILLER HEAD

BACKGROUND OF THE INVENTION

This invention is directed to the container filling art, and more specifically to a filler head of the type intended for delivery of a selectively variable, predetermined volume of product to a container.

A problem is presented, in the design of a multi-purpose filler of this type, by the need to accommodate a range of container sizes and shapes without objectionable turbulence and without sacrificing speed of operation. Another design requirement is ease in cleaning.

SUMMARY OF THE INVENTION

An object of this invention is to provide a filler head capable of delivering a preselected volume of product accurately and at a high speed of operation to a wide variety of container volumes and sizes with minimal turbulence as the container becomes filled, which is easily adjustable externally independently of other heads on the machine, and which is characterized by its relative simplicity and compactness, ease of assembly and dissassembly and ease of cleaning, and its durability and dependability, all in a relatively low cost construction.

DETAILED DESCRIPTION OF THE ILLUSTRATED EMBODIMENT

Figure 1:
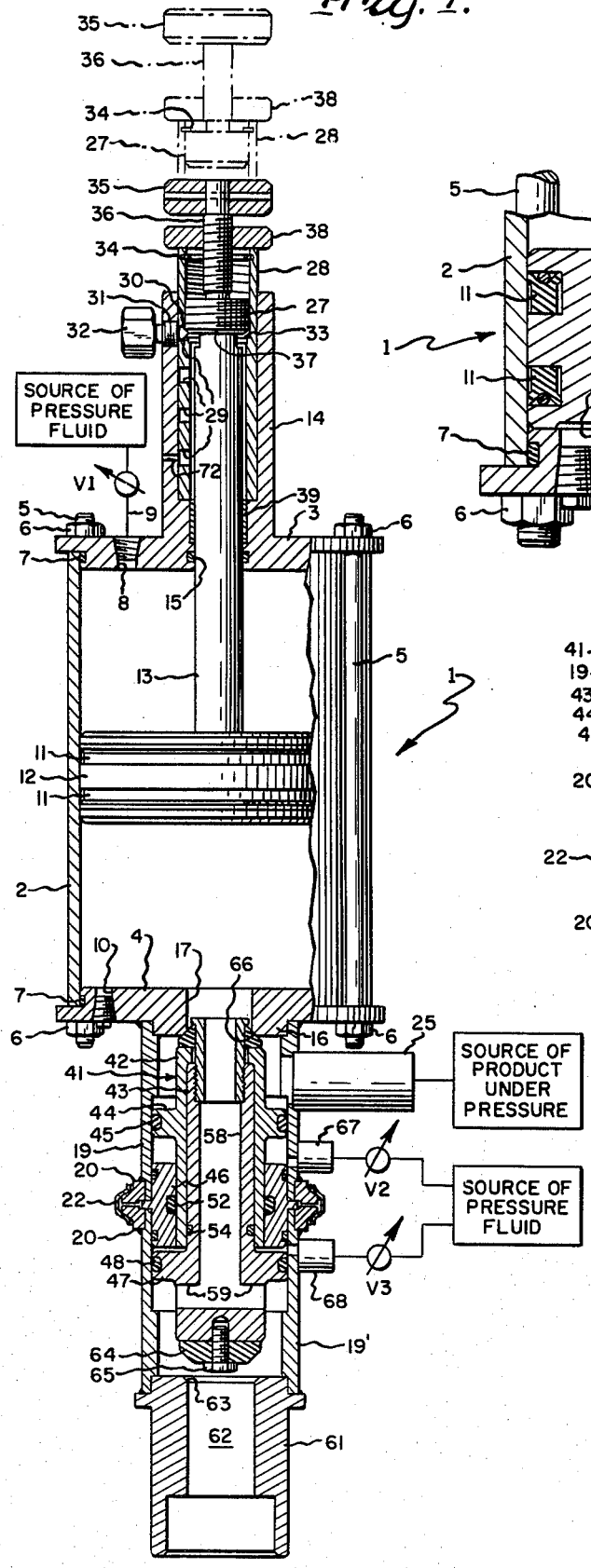
FIG. 1 is a longitudinal sectional view of a filler head of this invention, shown partly in elevation, the piston valve being shown in its position for discharge of product from the charging chamber through the valve to an outlet, and an alternative position of the adjustable stop being shown in phantom.

The filling head assembly of this invention can be used with a container filling machine of the type wherein a plurality of such heads are mounted around a central column, in conjunction with container supporting trays, containers to be filled being delivered in known manner to the container supporting trays which are moved with the filling heads through an arcuate path during which the containers are filled with product. Container filling machines of this type are well known, a machine of this general type being disclosed in U.S. Pat. No. 3,580,302 having a common assignee with this application and incorporated herein by reference. This invention is directed to the filling head which can be used with any suitable filling machine, whereby illustration and detailed description of the machine is believed to be unnecessary.

Referring now to the accompanying drawing, the filling head has a charging cylinder, generally designated 1, defined by a tubular shell 2 closed at its opposite ends by an upper cap plate member 3 and a lower base plate member 4, cap 3 and base 4 being held against the opposite ends of sleeve 2 by tie rods 5 extending therebetween exteriorly of shell 2, with nuts 6 bearing against plates 3 and 4 at opposite ends of the rods. Members 3 and 4 both overlie and extend within shell 2, with O-ring seals 7 providing a product tight enclosure. Cap

3 is provided with an opening 8 communicating via line 9 and a valve V1 with a source of pressure fluid, for a purpose to be described. A normally plugged opening 10 is provided through base plate 4, to vent air from beneath piston 12 at start-up.

A piston 12 is movable within the charging cylinder, having a piston rod 13 extending through cap 3 and into a first tubular member in the form of a cylinder cap sleeve 14 carried by plate 3 and having an O-ring 15 in sealing engagement with rod 13. Piston 12 carries seals 11 engaging shell 2. Piston rod 13 is guided by a sleeve bearing 39 as it moves within the tubular sleeve 14, thereby guiding and supporting the piston and rod assembly during movement thereof.

A collar 16 is provided in base plate 4, defining a product intake and discharge passage 17 between the charging cylinder and a tubular, sleeve-like body 19 secured to base plate 4 to extend downwardly therefrom and having a continuing extension 19'. The sections 19 and 19' are provided at their adjacent ends with brackets 20 secured thereto, and are releasably joined in end to end relation by a suitable clamp 22 of a type known in the art, for example a Ludish type clamp. Clamp 22 can be a pair of semi-circular parts bolted or otherwise releasably secured together in clamping relation to the body sections, the inclined surfaces of brackets 20 and clamp 22 coacting in the manner of a cam to clamp the body sections 19, 19' together.

It is a particular feature of this invention that a plug 23 having a stem 24 secured to the lower end of piston rod 13 projects below piston 12 for entry into passage 17 through collar 16 toward the end of the piston discharge stroke, thereby a restrict product discharge from the charging cylinder as the container nears its filled condition. For this purpose, plug 23 has sliding clearance with collar 16 sufficient to permit only limited product passage between plug 23 and the surrounding wall of passage 17. For example, the diametral clearance can be on the order of six to thirty thousandths of an inch.

Figure 2:
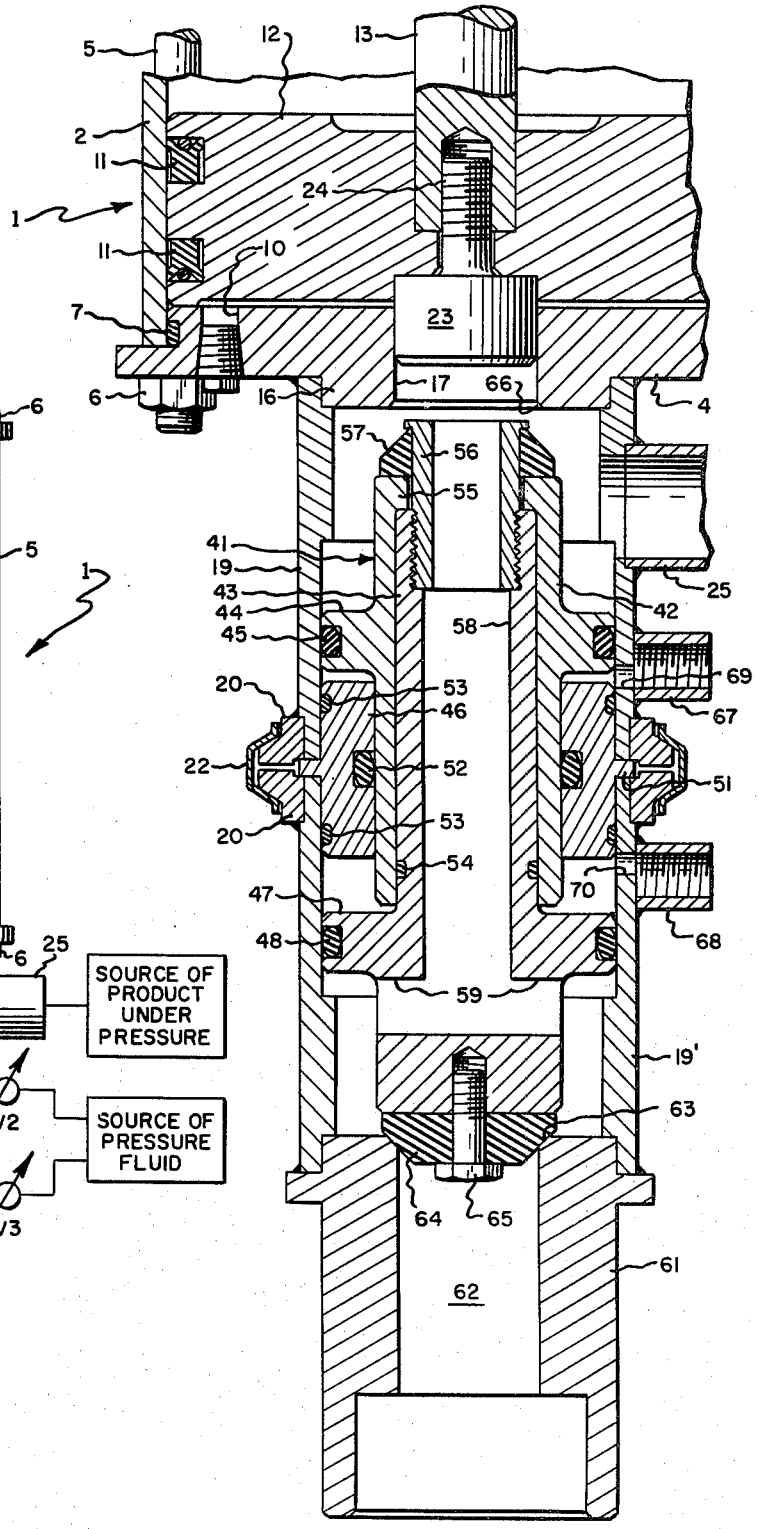
FIG. 2 is a similar, fragmentary view on an enlarged scale, the product piston being shown at the end of its discharge stroke, and the piston valve being shown in its position closing the outlet and permitting the delivery of product under pressure to the product chamber.

Product is delivered from a suitable source through a conduit 25 to body section 19 adjacent passage 17. With passage 17 open, as shown in FIG. 2, the product under pressure forces piston 12 upwardly, in a direction enlarging the chamber volume between piston 12 and base plate 4 which, together with shell 2, define a product chamber. The maximum volume of the product chamber is determined by the position of a piston rod stop having a body 27 threaded in the upper end of a tubular sleeve 28 telescoping within cap sleeve 14. Sleeve 28 is provided with a plurality of axially spaced openings 29 through its side wall, each opening being adapted to receive the stem 30 of an adjustment locking pin 31 threaded or otherwise releasably secured in an opening in the wall of cap sleeve 14, adjacent its upper end, and extending therethrough into an opening 29. Locking pin 31 has an enlarged head 32 for each in manipulating the pin to remove it from a particular opening 29 of sleeve 28, whereupon the latter can be moved lengthwise relative to cap sleeve 14 for insertion of pin 31 into a different opening 29 to secure sleeve 28 in a different position of extension relative to sleeve 14. This provides a rough adjustment in that it provides a series of spaced apart positions of stop 27, four such positions being provided in the illustrated embodiment although of course this number could be varied. A fine adjustment is provided by the stop 27 which can be threaded inwardly and outwardly of sleeve 28 between inner and outer positions as determined by the stepped shoulder 33 and a retaining ring 34, the stop being rotated by a fine adjustment knob 35 secured to the outer end of an externally threaded stem 36 projecting from stop 27 outwardly beyond sleeve 28, and locked in adjusted position by lock nut 38 threaded on the stem 36 and engaging the outer end of adjustment sleeve 28. In this way, with the position of sleeve 28 relative to sleeve 14 selected, stop member 27 can be rotated to precisely the desired stop position needed to limit the chamber enlarging movement of piston 12 by engagement of the end 37 of piston rod 13 against stop 27.

Product is alternatively delivered to and discharged from the charging cylinder chamber under control of a piston valve, generally designated 41, and it is another feature of this invention that valve 41 is movable as a unit to control both product intake and product discharge. In the illustrated embodiment, valve 41 has an upper tubular section 42 and a lower section 43 having a tubular portion received therein, the upper section being formed with an annular piston flange 44 carrying an O-ring seal 45 in sealing engagement with the wall of section 19 on one side of a piston guide 46, the lower section 43 being formed with an annular piston flange 47 carrying an O-ring seal 48 in sealing engagement with the wall of section 19' on the opposite side of guide 46. Guide 46 has an annular flange 51 clamped between body sections 19, 19' and carries an O-ring seal 52 in sealing engagement against the upper piston member 42 and O-rings 53 in sealing engagement against the sections 19, 19'. An O-ring 54 is carried by the lower piston section 43 in sealing engagement with the upper piston section 42.

At its upper end, piston valve section 42 has an inturned annular flange 55 overlying the upper end of the lower piston valve section 43. A tubular seal retainer 56 having an externally threaded inner end and an external flange at its outer end is threaded into the upper end of the piston section 43 and releasably secures the valve sections 42 and 43 in assembled relation and a seal 57 in place at the upper end of piston 41. Retainer 56 also provides a product discharge passage through seal 57 and retainer 56 in communication with a central passage 58 through valve 41 terminating at its lower end in lateral passages 59 for discharge of product into section 19' of the tubular body. A lower body extension 61 of tubular form providing a product outlet passage 62 therethrough is secured to the lower end of body section 19', and can be externally threaded to receive a filling stem. The body 61 has a beveled seat 63 around the inlet to passage 62.

A valve seal 64 is carried by the lower end of piston valve 41, being secured thereto by a screw 65 and having a beveled surface engaging seat 63 to close the product discharge passage 62 in one position of valve 41 as shown in FIG. 2. In its opposite position, shown in FIG. 1, valve 41 is shifted to engage the beveled surface of seal 57 against a beveled valve seat 66 around passage 17, interrupting the delivery of product under pressure to the charging chamber. Valve 41 is shifted between these two positions by pressure fluid from a suitable source, admitted through valves V2 and V3 to the interior of the tubular body 19, 19' via pipe couplings 67 and 68 communicating with the interior of the tubular body through openings 69 and 70, respectively. When valve V2 is open to admit pressure fluid through conduit 67 and passage 69, valve V3 is adjusted to vent the area above the piston 47, and valve 41 is shifted to engage valve seal 57 against seat 66. When valve V3 is adjusted to admit pressure fluid against piston 47, valve V2 vents the space below piston 44, and valve 41 is shifted to engage valve seal 64 against seal 64. Thus, the single piston valve 41 opens and closes both the intake and the discharge passage.

The valves V1, V2 and V3 are actuated by any of various means known in the art, for example either mechanical and electromechanical devices which are actuated as the filling head is moved through its path of movement in a manner well understood by those working in this art.

With the parts in the position shown in FIG. 2, product is delivered under pressure through passage 17 into the chamber between piston 12 and base plate 4, forcing the piston upwardly until rod end 37 engages stop 27, thereby defining a chamber volume corresponding to the selected volume of product with which the container is to be filled. The cylinder space above piston 12 is vented through passage 8 and valve V1, and the space above piston rod 13 is vented, as the rod moves into sleeve 28 via a vent 72 through cap sleeve 14. When the container is ready to receive product, valves V2 and V3 are activated to admit pressure fluid to the chamber beneath piston 44 and vent the chamber space above piston 47, shifting valve 41 to engage seal 57 against seat 66 as shown in FIG. 1. Pressure fluid is admitted to the charging cylinder above piston 12, moving it downwardly and discharging product through passage 17, retainer 56 and passages 58 and 59 into the lower end of body 19', around valve seal 64 and through the outlet passage 62. During this time, the delivery of product to the charging cylinder is interrupted. As the piston approaches the lower end of its product discharge stroke, the container will be nearing its filled condition. To reduce turbulence, the flow rate of product through passage 17 is substantially reduced at this point by entry of plug 23 into passage 17. This greatly restricts the passage area, and therefore significantly restricts the rate of flow of the substantially non-compressible product through passage 17 as the container approaches its filled condition. Once the complete charge of product has been delivered, valve 41 is shifted to close discharge passage 62, while opening passage 17 for the admission of product under pressure, and the cycle is repeated.

Accordingly, it is seen that this invention accomplishes its intended objects.

The provisions of plug 23 entering passage 17 to restrict the rate of flow of product through the passage, as piston 12 approaches the end of its discharge stroke, permits the filler head to be designed for filling containers having relatively large volumes while also accommodating containers having relatively small volumes and also those having irregular shapes where turbulence might otherwise present a problem, without sacrificing speed of operation.

Also, when it is desired to clean the head, clamp 22 is removed or released to permit removal of lower body section 19' and member 61, whereupon piston valve 41 is shipped out of body section 19' as a unit, together with guide member 46. Cleaning and replacement are thereby facilitated.

The various piston parts can be made of a suitable plastic material, for example Delrin, and the seals 57 and 64 also can be made of a suitable plastic material, for example urethane. The various other parts can be made of a stainless steel or other suitable metal or other material, it being understood that in all cases, in addition to structural integrity, the selected materials must be of a type which are inert relative to the product to which they are exposed and which are otherwise suitable for use for the intended purpose.

While a specific embodiment has been disclosed and described in detail, it will be appreciated that this has been done by way of illustration and that the scope of this invention is intended to be defined by the appended claims.

What is claimed is:

1. A filler head for delivering a preselected volume of product to a container comprising a charging cylinder, piston means movable in said cylinder to define therewith a product chamber, means for delivering product under pressure to said chamber, said piston means being movable under product pressure in a direction enlarging said chamber, means limiting movement of said piston means in said chamber-enlarging direction thereby determining said preselected volume, a tubular body, means defining a first product passage between said body and said chamber, a first valve seat around said first passage, a piston valve movable in said tubular body, said valve having a first valve seal at one end engageable against said first valve seat in a first position of said valve, means defining a second product passage from said body, a second valve seat around said second passage, a second valve seal at the opposite end of said piston valve engageable against said second valve seat in a second position of said valve, means defining a third product passage through said valve, said third passage having a product inlet opening through said first valve seal and a product outlet opening adjacent said opposite end of said valve, means for moving said valve between said first and second positions, said product delivering means communicating with said body between said valve and said first passage for delivery of product to said chamber in said second position of said valve, said valve interrupting the delivery of product to said chamber when in said first position, and means for moving said piston means in a direction discharging product through said first and third passages and through said second passage when said valve is in said first position.

2. A filler head as set forth in claim 1, said valve having a pair of pistons spaced apart lengthwise thereof in sealed sliding engagement with said body, a guide between said pistons in sealed sliding engagement with said valve, and means for selectively admitting pressure fluid between said guide and said pistons for moving said valve into and out of said first and second positions.

3. A filler head as set forth in claim 2, said valve comprising a pair of telescoped members each carrying one of said pistons, and means securing said members in telescoped relation for movement as a unit between said first and second positions.

4. A filler head as set forth in claim 3, said securing means comprising a tubular retainer carried by one of said valve members and securing said first seal thereto, said tubular retainer defining the inlet to said third passage.

5. A filler head as set forth in claim 4, said one member being within the other valve member and defining said third passage, said retainer being threaded in said one member.

6. A filler head as set forth in claim 1, said tubular body comprising a pair of tubular sections, one of said sections being connected to said charging cylinder, the other of said sections being releasably connected to said one section in end to end relation, said piston valve being removable as a unit from said body when said other section is disconnected from said one section.

7. A filler head as set forth in claim 6, said valve having a pair of pistons spaced apart lengthwise thereof, one of said pistons having sealed sliding engagement with said one section and the other of said pistons having sealed sliding engagement with said other section, means carried by said body in sealed sliding engagement with said valve between said pistons defining therewith a pair of chambers, and means for selectively admitting pressure fluid to said last-named chambers for shifting said valve between said first and second positions, said product delivering means communicating with said one body section between said first passage and said valve.

8. A filler head as set forth in claim 7, said means carried by said body comprising valve guide means releasably clamped between said body sections and removable as a unit with said valve upon disconnecting said sections.

9. A filler head as set forth in claim 1, together with means restricting product flow through said first passage as said piston means approaches the end of its product discharging movement.

10. A filler head as set forth in claim 9, said restricting means comprising a plug carried by said piston means for entry into said first passage, said plug significantly reducing the area available for product flow through said first passage.

11. A filler head as set forth in claim 1, wherein said means limiting movement of said piston means include a first tubular member communication with said cylinder, a second tubular member mounted in telescoping relation to said first member, stop means carried by said second member, piston rod means carried by said piston means for movement therewith through said member into engagement against said stop means, means for adjusting the position of said stop means lengthwise of second member, and means for adjusting the telescoped position of said second member relative to said first member.

12. A filler head for delivering a preselected volume of product to a container comprising a charging cylinder, piston means movable in said cylinder to define therewith a product chamber, means for delivering product under pressure to said chamber, said piston means being movable under product pressure in a direction enlarging said chamber, means limiting movement of said piston means in said chamber-enlarging direction thereby determining said preselected volume, an outlet from said filler head, means for moving said piston means in a direction discharging product from said chamber through said outlet, valve means closing said outlet during delivery of product to said chamber and interrupting such product delivery during discharge of product from said chamber, said means limiting movement of said piston means including a first tubular member communicating with said cylinder, a second tubular member mounted in telescoping relation to said first member, stop means carried by said second member, piston rod means carried by said piston means for movement therewith through said members into engagement against stop means, means for adjusting the position of said stop means lengthwise of second member, and means for adjusting the telescoped position of said second member relative to said first member.

13. A filler head as set forth in claim 12, said stop means having threaded engagement with said second member for selective position adjustment lengthwise thereof, together with means for releasably securing said stop means in adjusted position.

14. A filler head as set forth in claim 13, said last named securing means comprising a lock nut threaded on said stop means for engagement against said second means.

15. A filler head as set forth in claim 12 or claim 13, said means for adjusting the telescoped position of said members comprising a series of pin receiving openings in one of said members spaced apart lengthwise thereof, and an adjustment locking pin carried by the other of said members for releasable engagement in a selected one of said openings.

* * * * *